US010057674B1

(12) United States Patent
Tseng et al.

(10) Patent No.: US 10,057,674 B1
(45) Date of Patent: Aug. 21, 2018

(54) HEADPHONE SYSTEM CAPABLE OF ADJUSTING EQUALIZER GAINS AUTOMATICALLY

(71) Applicant: Toong In Electronic Corp., New Taipei (TW)

(72) Inventors: Teng-Sung Tseng, New Taipei (TW); Chi-Wei Chang, New Taipei (TW)

(73) Assignee: Toong In Electronic Corp., New Taipei (TW)

( * ) Notice: Subject to any disclaimer, the term of this patent is extended or adjusted under 35 U.S.C. 154(b) by 0 days.

(21) Appl. No.: 15/803,851

(22) Filed: Nov. 6, 2017

(30) Foreign Application Priority Data

Jul. 26, 2017 (TW) ..... 106125011 A

(51) Int. Cl.
*H04R 1/10* (2006.01)
*H04R 3/04* (2006.01)

(52) U.S. Cl.
CPC ..... *H04R 1/1041* (2013.01); *H04R 1/1008* (2013.01); *H04R 3/04* (2013.01)

(58) Field of Classification Search
CPC ..... H04R 1/1008; H04R 2420/07; H04R 1/1041; H04R 1/1058; H04M 1/05
See application file for complete search history.

(56) References Cited

U.S. PATENT DOCUMENTS 6,445,805 B1 * 9/2002 Grugel ..... H04R 5/0335 181/129
2005/0220318 A1 * 10/2005 Han ..... H04R 1/1008 381/371
2006/0262938 A1 * 11/2006 Gauger, Jr. ..... G10L 21/02 381/56
2010/0246807 A1 9/2010 Kemmochi
2010/0310093 A1 * 12/2010 Semcken ..... H04R 1/1058 381/104
2012/0027239 A1 * 2/2012 Akino ..... H04R 1/28 381/345
2012/0304367 A1 * 12/2012 Howard ..... A42B 3/046 2/413

(Continued)

FOREIGN PATENT DOCUMENTS

CN 101854571 A 10/2010
CN 103686508 A 3/2014

(Continued)

*Primary Examiner* — Mohammad Islam
(74) *Attorney, Agent, or Firm* — Winston Hsu

(57) ABSTRACT

A headphone system includes a headphone body and a signal source device. The headphone body includes a connection kit, a first earmuff module, a second earmuff module, a connection port, and a processor. The first earmuff module is connected to a first terminal of the connection kit. The first earmuff module includes at least one first pressure sensor and a first speaker. The second earmuff module is connected to a second terminal of the connection kit. The second earmuff module includes at least one second pressure sensor and a second speaker. The connection port is used for receiving an audio source signal from the signal source device. The processor receives a plurality of pressure values detected by the at least one first pressure sensor and second pressure sensor and sets at least one set of equalizer gains of the first speaker and the second speaker according to the pressure values.

10 Claims, 10 Drawing Sheets

(56) References Cited

U.S. PATENT DOCUMENTS

| | | | | |
|---|---|---|---|---|
| 2013/0083933 | A1 | 4/2013 | Aase | |
| 2013/0129106 | A1* | 5/2013 | Sapiejewski | H04R 1/105 381/71.6 |
| 2013/0177165 | A1* | 7/2013 | Oishi | H04R 1/1041 381/74 |
| 2013/0259241 | A1* | 10/2013 | Schul | H04R 3/002 381/56 |
| 2013/0272560 | A1 | 10/2013 | Dougherty | |
| 2014/0064500 | A1 | 3/2014 | Lee | |
| 2014/0314245 | A1* | 10/2014 | Asada | G10K 11/1788 381/71.6 |
| 2015/0086030 | A1* | 3/2015 | Moriai | H04M 19/047 381/59 |
| 2015/0382120 | A1 | 12/2015 | Baskaran | |
| 2016/0366507 | A1 | 12/2016 | Hou | |
| 2016/0366518 | A1 | 12/2016 | Strogis | |
| 2018/0041828 | A1* | 2/2018 | Sibbald | H04R 1/1083 |

FOREIGN PATENT DOCUMENTS

| | | | |
|---|---|---|---|
| CN | 104041070 | A | 9/2014 |
| EP | 3 035 698 | A1 | 6/2016 |
| JP | S55-39460 | A | 3/1980 |
| JP | 2006-304052 | A | 11/2006 |
| WO | 99/05998 | A1 | 2/1999 |

* cited by examiner

HEADPHONE SYSTEM CAPABLE OF ADJUSTING EQUALIZER GAINS AUTOMATICALLY

BACKGROUND OF THE INVENTION

1. Field of the Invention

The present invention illustrates a headphone system, and more particularly, a headphone system capable of adjusting equalizer gains automatically according to pressure values.

2. Description of the Prior Art

With advancement of technologies, various headphones are popularly applied to personal computers, notebooks, smart phones, tablets, and music players for providing satisfactory auditory experience. According to user's requirements, headphones can be categorized in different types, such as circumaural headphones, supra-aural headphones, earbuds and canalphones.

In general, circumaural headphones have big size. Since audio devices of the circumaural headphones cover two pinnas completely, they can provide comfortable wearing experience. Further, since the circumaural headphones have big size, the circumaural headphones are usually used inside a room, such as a studio. Particularly, size of the supra-aural headphones is smaller than size of the circumaural headphones. Each audio device of the supra-aural headphones tightly presses one pinna. Thus, the supra-aural headphones can provide higher portability than the circumaural headphones. Audio devices of the earbuds are disposed outside earholes. Specifically, the earbuds are portable and can be designed by using small size components, thereby achieving high convenience. Also, the earbuds can be easily manufactured with low cost. Therefore, earbuds become the most popular headphones for the users. However, a sound isolation capability of the earbuds under noisy environment is poor. Further, an intensity of sound field generated from the earbuds is insufficient, thereby leading to poor tone quality. Canalphones also take advantages of small size, high portability, and high convenience. However, audio devices of the canalphones are deep inside ear-canals. Thus, audio outputted from the audio devices is very close to eardrums.

Recently, since high tone quality of the headphones is required by the user, the circumaural headphones and supra-aural headphones have been gradually used in our daily life. However, since head shapes and ear shapes of the users are different, equivalent airtight spaces or resonant cavities of the headphones may be varied when the circumaural headphones or the supra-aural headphones are fitted and touch ears. In other words, even the circumaural headphones and supra-aural headphones are initially designed to satisfy a standard equalizer gain curve, since the head shapes and ear shapes of the users are different, frequency gains of sound heard by the ears through different resonant cavities maybe distorted. Unfortunately, general circumaural headphones or supra-aural headphones cannot improve auditory experience by optimizing equalizer gains according to a specific head shape and a specific ear shape of the user.

SUMMARY OF THE INVENTION

In an embodiment of the present invention, a headphone system is disclosed. The headphone system comprises a headphone body and an audio source. The headphone body comprises a connection kit, a first earmuff module, a second earmuff module, a connection port, and a processor. The first earmuff module is connected to a first terminal of the connection kit. The first earmuff module comprises at least one first pressure sensor and a first speaker. The second earmuff module is connected to a second terminal of the connection kit. The second earmuff module comprises at least one second pressure sensor and a second speaker. The connection port is configured to receive an audio source signal. The processor is coupled to the at least one first pressure sensor, the at least one second pressure sensor, the first speaker, the second speaker, and the connection port, and configured to control the first speaker and the second speaker. The audio source is coupled to the connection port of the headphone body and configured to generate the audio source signal. The processor receives a plurality of pressure values detected by the at least one first pressure sensor and the at least one second pressure sensor. The processor sets a set of equalizer gains for controlling the first speaker and the second speaker according to the plurality of pressure values.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
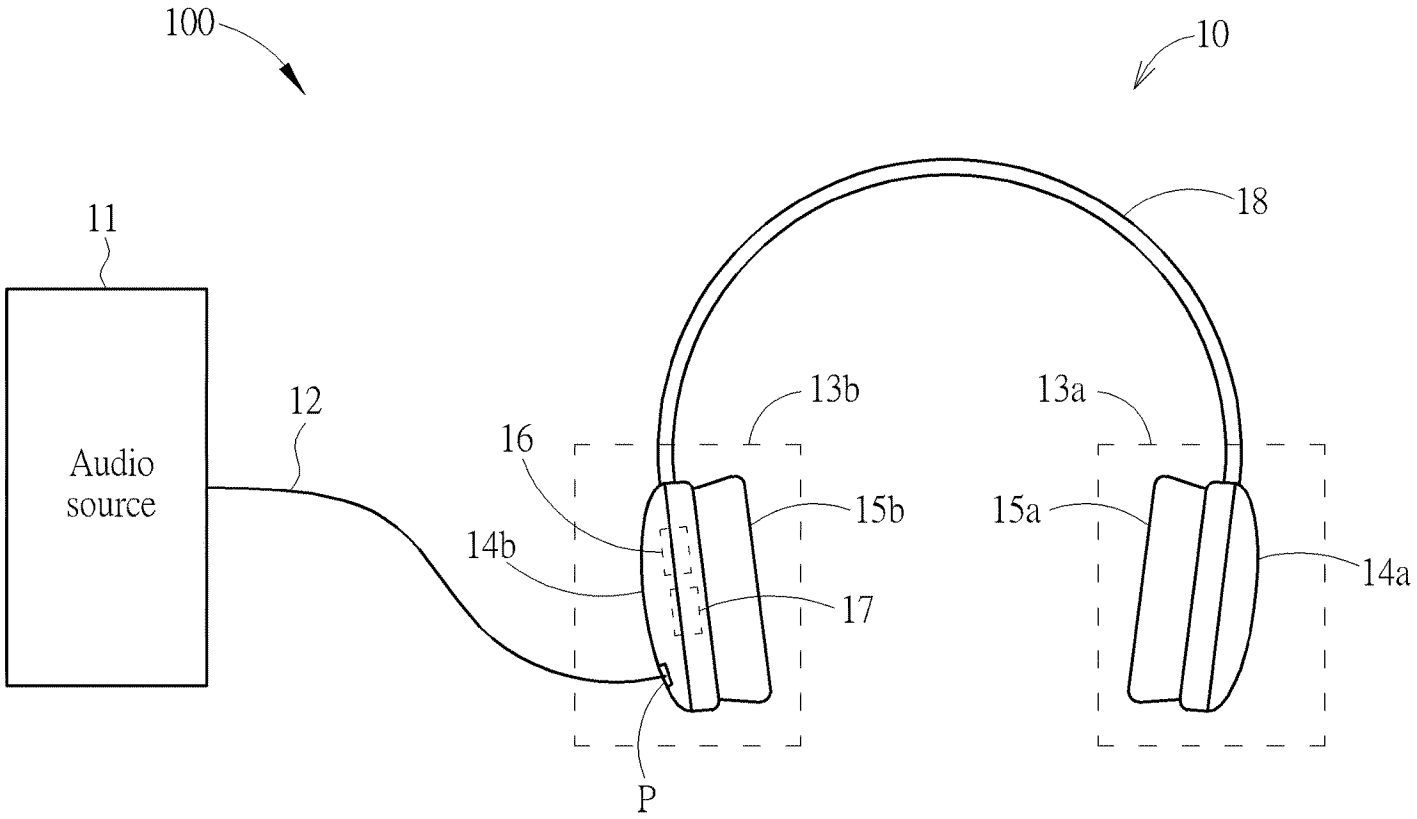
FIG. 1 is a structure of a headphone system according to an embodiment of the present invention.
Figure 2:
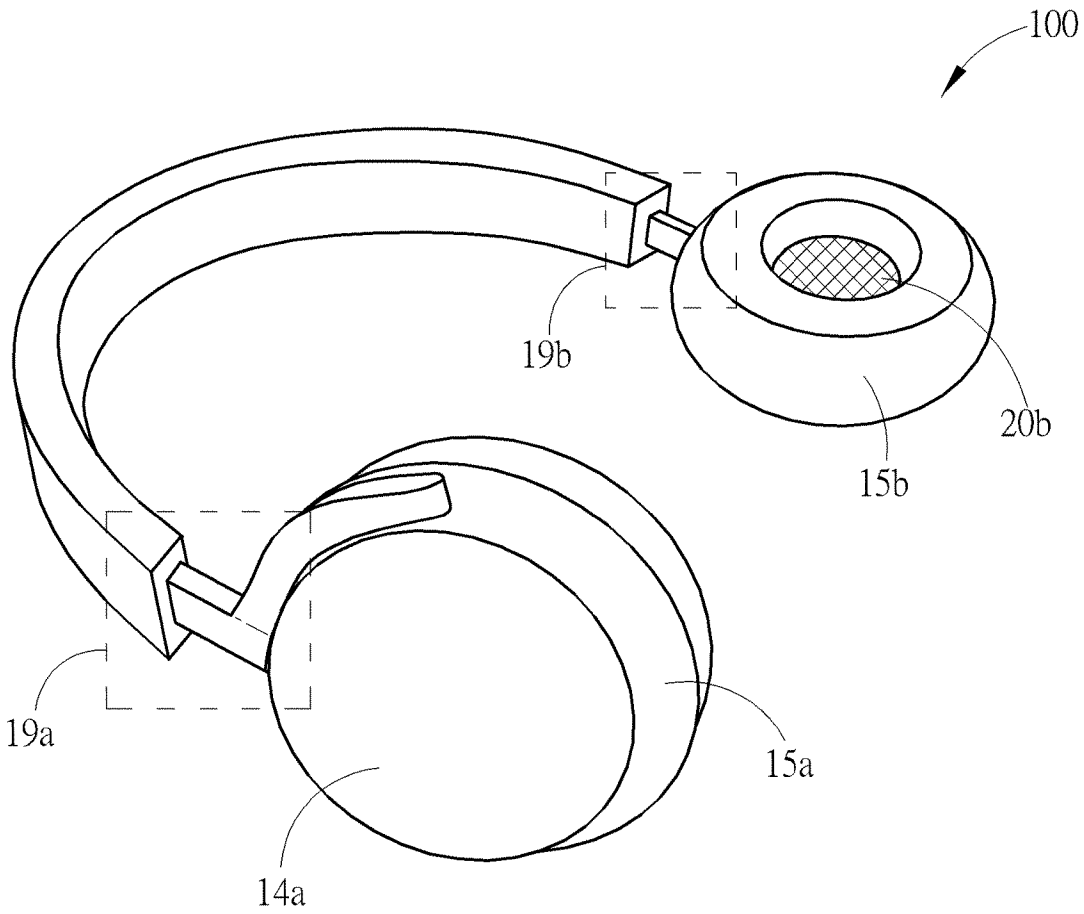
FIG. 2 is an illustration of side view of the headphone system in FIG. 1.
Figure 3:
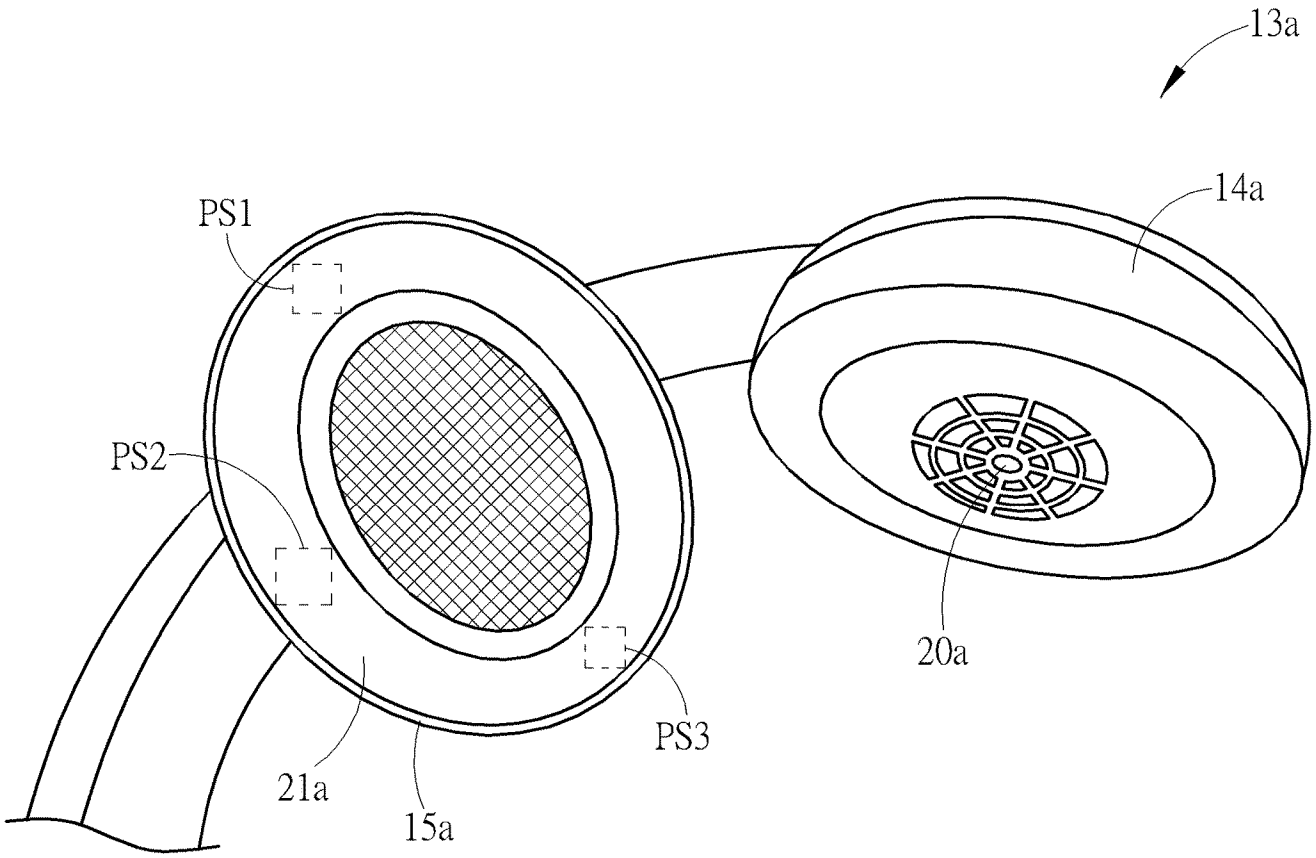
FIG. 3 is an illustration of a first earmuff module of the headphone system in FIG. 1.

FIG. 1 is a structure of a headphone system 100 according to an embodiment of the present invention. FIG. 2 is an illustration of side view of the headphone system 100. FIG. 3 is an illustration of a first earmuff module 13*a* of the headphone system 100. The headphone system 100 includes a headphone body 10 and an audio source 11. The headphone body 10 can be a circumaural headphone body or a supra-aural headphone body. The audio source 11 can be any device capable of generating audio signals, such as a personal computer, a tablet, a smart phone, or a music player. The headphone body 10 can establish a wired connection link to the audio source 11 by using a cable 12 through a connection port P. However, the headphone body 10 can establish a wireless connection link to the audio source 11. For example, a Bluetooth wireless protocol or a Wi-Fi wireless protocol can be introduced for establishing the wireless connection link. The headphone body 10 includes a connection kit 18, a first earmuff module 13*a*, a second earmuff module 13*b*, the connection port P, and a processor 16. Here, although the connection port P and the processor 16 in FIG. 1 are disposed inside the second earmuff module 13*b*, the present invention is not limited to FIG. 1. For example, the connection port P and the processor 16 can be disposed at any position or any space inside the headphone body 10. The connection kit 18 can be formed as a belt structure, such as an arc metal strip structure or an arc plastic strip structure. The first earmuff module 13*a* is connected to a first terminal of the connection kit 18 (i.e., for example, a right terminal) for generating sound to a right ear of a user. The first earmuff module 13*a* includes a plurality of first pressure sensors PS1 to PS3 (shown in FIG. 3 and FIG. 4A) and a first speaker 20*a* (shown in FIG. 3). The first pressure sensors PS1 to PS3 can be used for detecting pressures when the first earmuff module 13*a* is fitted and touched behind the right ear, above the right ear, and/or under the right ear. Further, the first earmuff module 13*a* can be an airtight earmuff module. A definition of the airtight earmuff module is that when the user wears the headphone body 10, high tightness between the first earmuff module 13*a* and a pinna can be achieved, thereby capable of isolating noise and conductive medium from external environment. Equivalently, a closed resonant cavity can be generated between the first earmuff module 13*a* and a right pinna. The first earmuff module 13*a* further includes a first back cover support 14*a* and a first earmuff device 15*a*. The first back cover support 14*a* can be a back cover support formed by a hard material. The first back cover support 14*a* is coupled to the connection kit 18. Alternatively, as shown in FIG. 2, a first pivoted device 19*a* can be disposed on the first terminal of the connection kit 18. The first back cover support 14*a* can rotate around the first pivoted device 19*a*. The first earmuff device 15*a* is disposed on the first back cover support 14*a*. Further, the first earmuff device 15*a* can be formed by a soft material, such as a foam material.

Similarly, in FIG. 1, the second earmuff module 13*b* is connected to a second terminal of the connection kit 18 (i.e., for example, a left terminal) for generating sound to a left ear of the user. The second earmuff module 13*b* includes a plurality of second pressure sensors PS4 to PS6 (shown in FIG. 4B) and a second speaker 20*b* (shown in FIG. 2). The second pressure sensors PS4 to PS6 can be used for detecting pressures when the second earmuff module 13*b* is fitted and touched behind the left ear, above the left ear, and/or under the left ear. Further, the second earmuff module 13*b* can be an airtight earmuff module capable of isolating noise and conductive medium from external environment. A closed resonant cavity can be generated between the second earmuff module 13*b* and a left pinna. The second earmuff module 13*b* further includes a second back cover support 14*b* and a second earmuff device 15*b*. The second back cover support 14*b* can be a back cover support formed by a hard material. The second back cover support 14*b* is coupled to the connection kit 18. Alternatively, as shown in FIG. 2, a second pivoted device 19*b* can be disposed on the second terminal of the connection kit 18. The second back cover support 14*b* can rotate around the second pivoted device 19*b*. The second earmuff device 15*b* is disposed on the second back cover support 14*b*. Further, the second earmuff device 15*b* can be formed by a soft material, such as a foam material.

In the headphone body 10, the processor 16 is coupled to the plurality of first pressure sensors PS1 to PS3, the plurality of second pressure sensors PS4 to PS6, the first speaker 20*a*, the second speaker 20*b*, and the connection port P for controlling the first speaker 20*a* and the second speaker 20*b*. The processor 16 can receive a plurality of pressure values detected by using the plurality of first pressure sensors PS1 to PS3 and the plurality of second pressure sensors PS4 to PS6. Further, the processor 16 can set a set of equalizer gains for controlling the first speaker 20*a* and the second speaker 20*b* according to the plurality of pressure values so that the equivalent equalizer gains of sound heard by human ears correspond to a standard equalizer gain curve.

In the headphone system 100, positions and shapes of all components are not limited to FIG. 1 to FIG. 3. For example, the processor 16 of the headphone body 10 can be disposed on any place.

Shapes of the first back cover support 14*a*, the second back cover support 14*b*, the first earmuff device 15*a*, and the second earmuff device 15*b* of the headphone body 10 are not limited to FIG. 2. For example, components of the two earmuff module (13*a* and 13*b*) can be polygon shaped components. The first earmuff module 13*a* can include a single pressure sensor. The second earmuff module 13*b* can include a single pressure sensor. Any reasonable material, shape, or functionality modification of the headphone system 100 falls into the scope of the present invention.

FIG. 3 is an illustration of a first earmuff module 13*a* of the headphone system 100. As previously mentioned, the first earmuff module 13*a* includes the first back cover support 14*a* and the first earmuff device 15*a*. As shown in FIG. 3, the first back cover support 14*a* can be a covered shell formed by the hard material for covering the first speaker 20*a*. The first earmuff module 13*a* further includes a first partition 21*a* disposed between the first back cover support 14*a* (i.e., formed by the hard material) and the first earmuff device 15*a* (i.e., formed by the soft material). Here, the first partition 21*a* can be formed by a hard material, such as a plastic material or an acrylic material. The first earmuff device 15*a* can be disposed around the first partition 21*a*. A side of the first partition 21*a* can be used for disposing the plurality of first pressure sensors PS1 to PS3. As previously mentioned, when the first earmuff module 13*a* is fitted and touches an ear, since the first earmuff device 15*a* is formed by the soft material, the first pressure sensors PS1 to PS3 can detect pressures from different positions and then generate pressure values accordingly. In other words, since the first earmuff device 15*a* is formed by the soft material, when the first earmuff module 13*a* is fitted and touches an ear, deformation of the first earmuff device 15*a* may occur because of the pressures. For example, the first pressure sensor PS1 can be used for detect pressure of a position above a right ear when the deformation of the first earmuff device 15*a* above the right ear occurs. Thus, the first pressure sensor PS1 can generate a pressure value corresponding to the position above the right ear. The first pressure sensor PS2 can be used for detecting pressure of a position behind the right ear when the deformation of the first earmuff device 15*a* behind the right ear occurs. Thus, the first pressure sensor PS2 can generate a pressure value corresponding to the position behind the right ear. The first pressure sensor PS3 can be used for detecting pressure of a position under the right ear when the deformation of the first earmuff device 15*a* under the right ear occurs. Thus, the first pressure sensor PS3 can generate a pressure value corresponding to the position under the right ear. Further, when a lot of pressure sensors are introduced to the first earmuff module 13*a* , the first earmuff module 13*a* is capable of generating many pressure values corresponding to a lot of positions. On the contrary, when a few of pressure sensors are introduced to the first earmuff module 13*a*, the first earmuff module 13*a* is capable of generating a few pressure values corresponding to a few positions. Additionally, allocations of the pressure sensors are not limited to FIG. 3. For example, pressure sensors (i.e., the first pressure sensors) can be uniformly distributed or centralized within a range. Any reasonable technology modification falls into the scope of the present invention. Further, functionalities of all components of the second earmuff module 13*b* are similar to the components of the first earmuff module 13*a*. Thus, illustrations are omitted here.

Figure 4A:
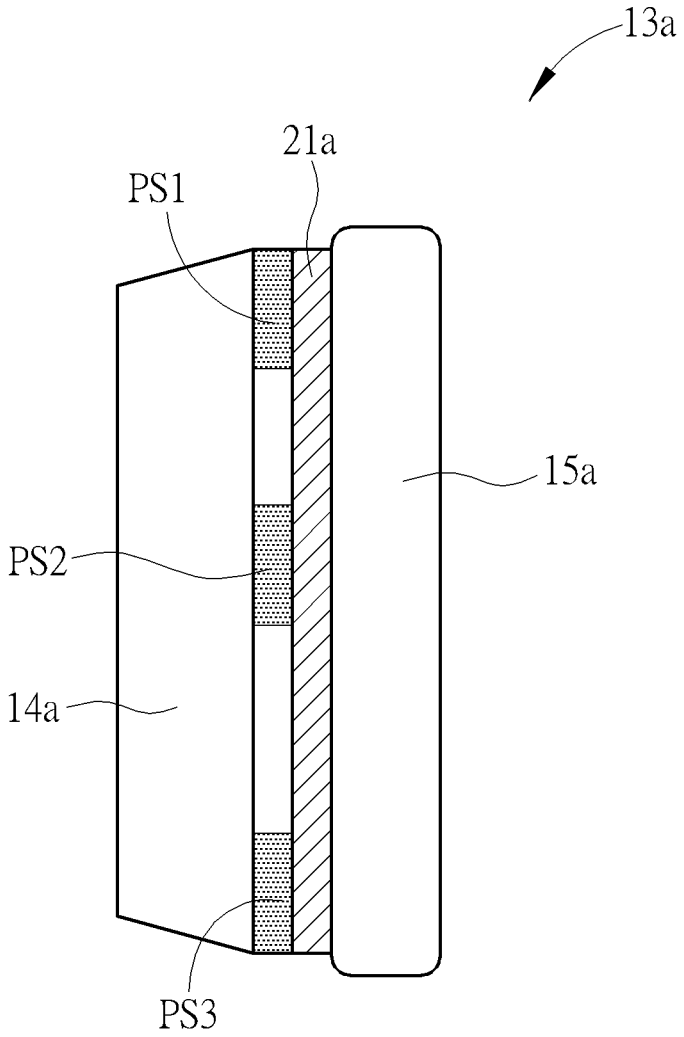
FIG. 4A is a first structure of the first earmuff module of the headphone system in FIG. 1.
Figure 4B:
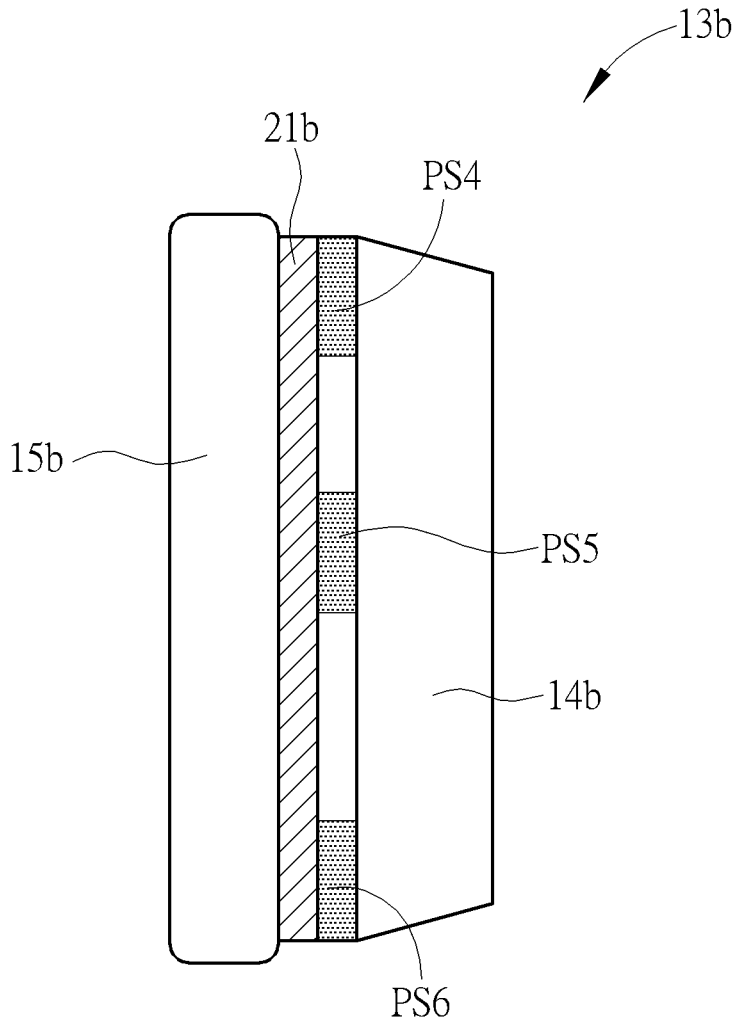
FIG. 4B is a first structure of a second earmuff module of the headphone system in FIG. 1.

FIG. 4A is a first structure of the first earmuff module 13*a* of the headphone system 100. FIG. 4B is a first structure of the second earmuff module 13*b* of the headphone system 100. As shown in FIG. 4A, the first pressure sensors PS1 to PS3 are disposed between the first back cover support 14*a* and the first partition 21*a*. When the first earmuff device 15*a* is fitted and touches an ear, the first pressure sensors PS1 to PS3 can detect pressures of three positions. For example, the first pressure sensor PS1 can detect pressure of a position above a right ear and generate a pressure value corresponding to the position above the right ear. Further, since the first partition 21*a* can be formed by the hard material, pressures of all positions of the first earmuff device 15*a* can be averaged and then transmitted to the first pressure sensors PS1 to PS3. In other words, for the first pressure sensor PS1, it can detect the pressure of the position above the right ear in conjunction with an averaged pressure of all positions of the first earmuff device 15*a*. Similarly, the first pressure sensors PS2 and PS3 can detect pressures of corresponding positions in conjunction with the averaged pressure of all positions of the first earmuff device 15*a*. Further, the structure and functionalities of the second earmuff module 13*b* in FIG. 4B are similar to the structure and functionalities of the first earmuff module 13*a* in FIG. 4A. Thus, illustrations of the second earmuff module 13*b* in FIG. 4B are omitted here.

Figure 5A:
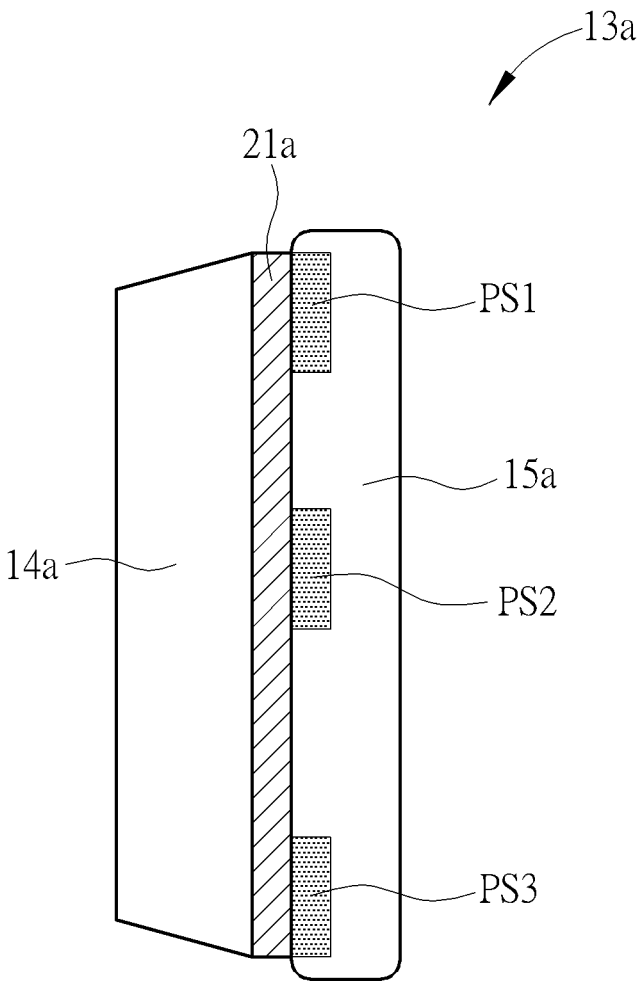
FIG. 5A is a second structure of the first earmuff module of the headphone system in FIG. 1.
Figure 5B:
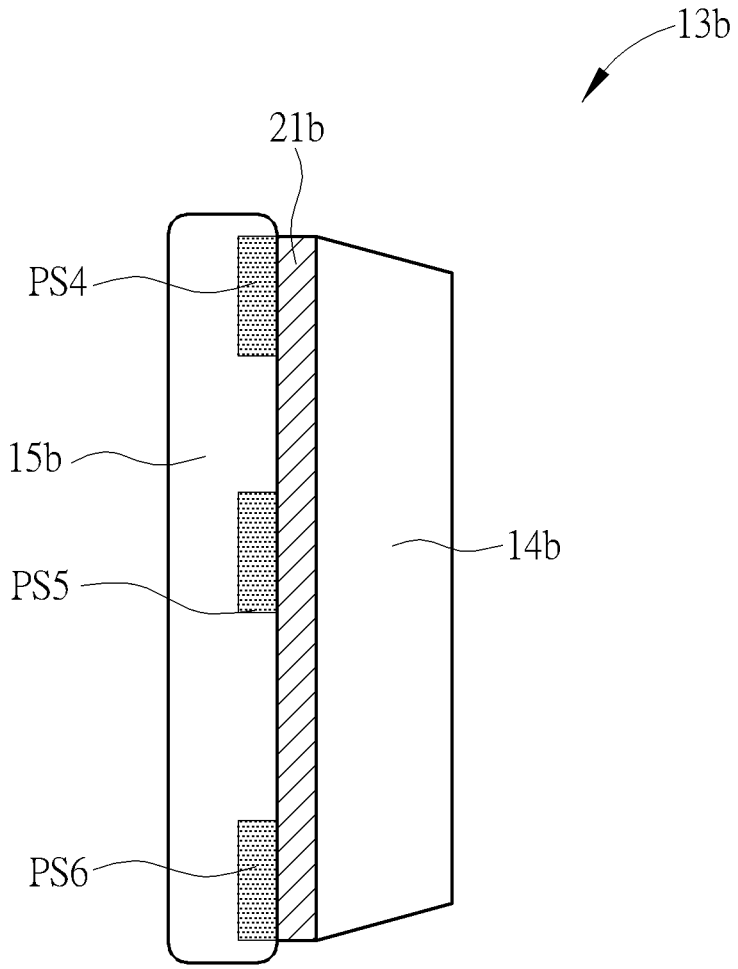
FIG. 5B is a second structure of the second earmuff module of the headphone system in FIG. 1.

FIG. 5A is a second structure of the first earmuff module 13*a* of the headphone system 100. FIG. 5B is a second structure of the second earmuff module 13*b* of the headphone system 100. In FIG. 5, the first pressure sensors PS1 to PS3 are disposed on a side of the first partition 21*a*, facing the first earmuff device 15*a*. Further, the first earmuff device 15*a* can cover the first pressure sensors PS1 to PS3. When the first earmuff device 15*a* is fitted and touches an ear, the first pressure sensors PS1 to PS3 can detect pressures of three positions. For example, the first pressure sensor PS1 can detect pressure of a position above a right ear and generate a pressure value corresponding to the position above the right ear. Particularly, since the first pressure sensor PS1 can directly detect the pressure according to extent of deformation of the first earmuff device 15*a* above the right ear, high detection accuracy of the first pressure sensor PS1 can be achieved. Similarly, the first pressure sensor PS2 and the first pressure sensor PS3 can also provide high detection accuracy. Further, the structure and functionalities of the second earmuff module 13*b* in FIG. 5B are similar to the structure and functionalities of the first earmuff module 13*a* in FIG. 5A. Thus, illustrations of the second earmuff module 13*b* in FIG. 5B are omitted here.

Figure 6:
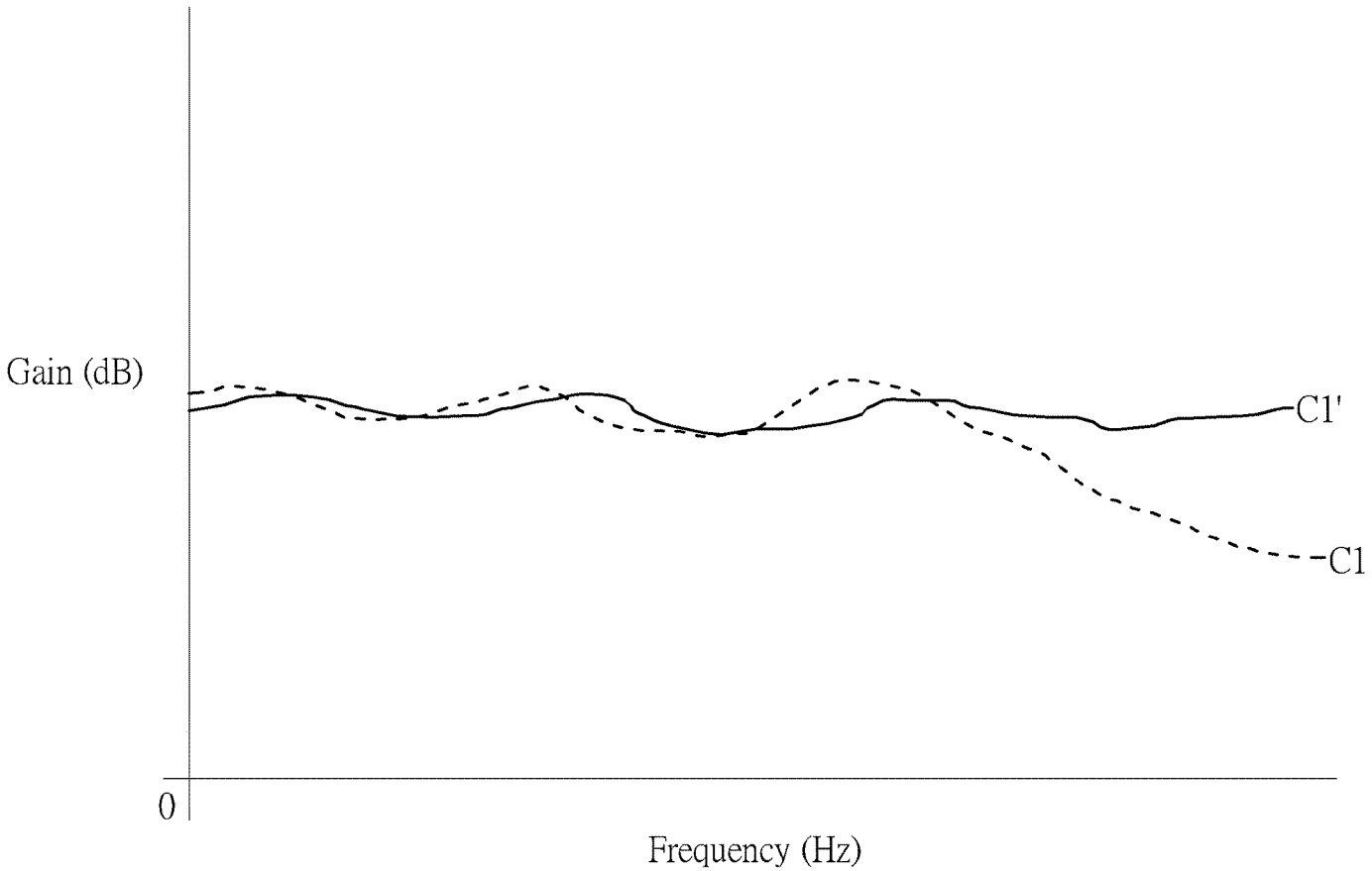
FIG. 6 is an illustration of initial equalizer gains before they are adjusted according to detection results of at least one pressure sensor of the headphone system in FIG. 1.

FIG. 6 is an illustration of initial equalizer gains before they are adjusted according to detection results of at least one pressure sensor of the headphone system 100. As previously mentioned, the first earmuff module 13*a* and the second earmuff module 13*b* are airtight earmuff modules capable of isolating noise and conductive medium from external environment. Further, two closed resonant cavities can be respectively generated between the first earmuff module 13*a* and a right pinna, and between the second earmuff module 13*b* and a left pinna. For the first earmuff module 13*a*, when the first earmuff module 13*a* is fitted and touches a right ear, the resonant cavity generated between the first earmuff module 13*a* and the right pinna of the right ear may be varied according to shape or size of the right ear. Specifically, variations of the resonant cavity may cause fluctuations of frequency gains of sound heard by human ear. Here, "frequency gains" can be regarded as "equalizer gains" or "frequency responses". By definition, an equalizer gain of sound can be regarded as a "gain" at a certain frequency of frequency spectrum of the sound. In FIG. 6, the first speaker 20*a* of the first earmuff module 13*a* can generate sound with equalizer gains consistent with an equalizer gain curve C1 (i.e., dotted line) . However, even the equalizer gain curve C1 can be regarded as a standard equalizer gain curve, for different users, the sound may be changed because of shapes or sizes of the user's ears. In other words, since the resonant cavity may be changed, some frequency gains (or say, equalizer gains) of the sound spectrum may be changed. For example, gains of high frequency region or low frequency region of the sound spectrum may be increased or decreased according to variations of the resonant cavity. In the embodiment, the right ear can hear the sound with the equalizer gain curve C1'. In other words, the equalizer gain curve C1' can be regarded as a "changed" equalizer gain curve compared with the equalizer gain curve C1 outputted from the first speaker 20*a*. In FIG. 6, when the equalizer gain curve C1 is a standard equalizer gain curve, the right ear can hear high decibel sound at a high frequency since gains of the equalizer gain curve C1' are increased at a higher frequency. Therefore, the user may hear sharp sound, leading to undesirable auditory experience. However, the equalizer gain curves C1 and C1' in FIG. 6 belong to an embodiment for illustrating a gain offset phenomenon of the sound spectrum. The difference between the equalizer gain curve C1 and the equalizer gain curve C1' is not limited to FIG. 6. To avoid tone distortion, the headphone system 100 has to perform a mechanism for adjusting the equalizer gain curve outputted from the speaker in order to optimize the equalizer gains of sound heard by human ear.

Figure 7:
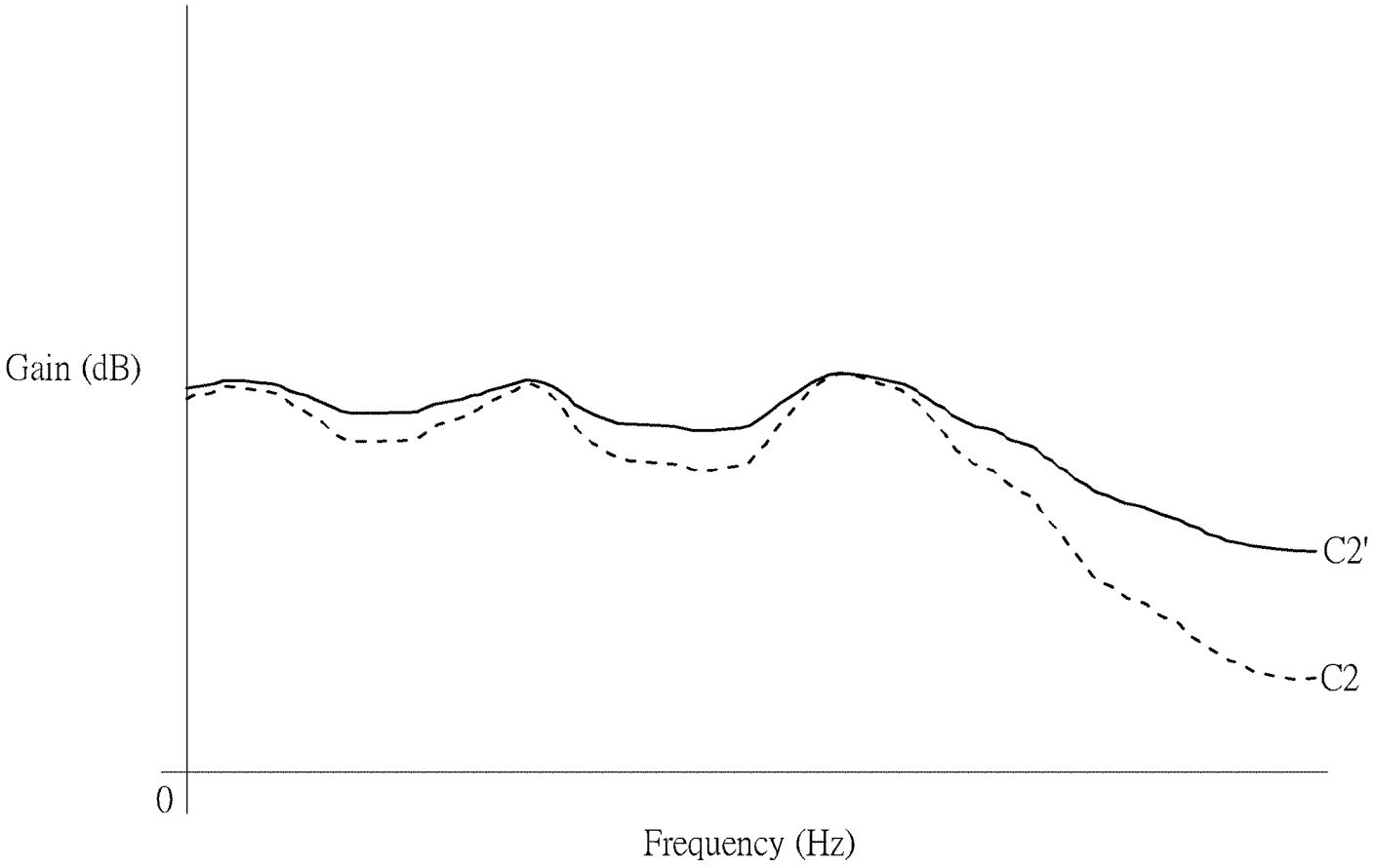
FIG. 7 is an illustration of adjusted equalizer gains according to the detection results of at least one pressure sensor of the headphone system in FIG. 1.

FIG. 7 is an illustration of adjusted equalizer gains according to the detection results of at least one pressure sensor of the headphone system 100. As previously mentioned, for the first earmuff module 13*a*, even the first speaker 20*a* can generate the sound consistent with the standard equalizer gain curve C1, some frequency gains of the sound spectrum heard by human ear may be changed (i.e. , becomes the equalizer gain curve C1') . Therefore, in FIG. 7, an equalizer gain curve C2 of the sound outputted from the first speaker 20*a* of the first earmuff module 13*a* should be adjusted. By adjusting the equalizer gain curve C2, one purpose is to optimize an equalizer gain curve C2' of sound heard by human ear consistent with the standard equalizer gain curve. For example, the headphone body 10 can further include a memory 17. The memory 17 is coupled to the processor 16 for saving a set of equalizer gains corresponding to the plurality of pressure values. By definition, the "equalizer gain curve" can be formed by a connection line through a plurality of frequency gains of the sound spectrum. Thus, the "equalizer gain curve" can include a set of equalizer gains. The processor 16 can set a set of equalizer gains for controlling the first speaker 20*a* and the second speaker 20*b* according to the plurality of pressure values. For example, the equalizer gain curve C2 of the first speaker 20*a* can be set as a curve presented in FIG. 7 so that the equalizer gain curve C2' of the sound heard by human ear can be consistent with the standard equalizer gain curve. However, the present invention is not limited to using the memory 17 or a query table for generating an appropriate equalizer gain curve according to the plurality of pressure values. For example, a numerical analysis process can be introduced to the headphone system 100 for generating the appropriate equalizer gain curve by the processor 16. Any method for generating the standard equalizer gain curve of sound heard by human ears falls into the scope of the present invention.

Figure 8:
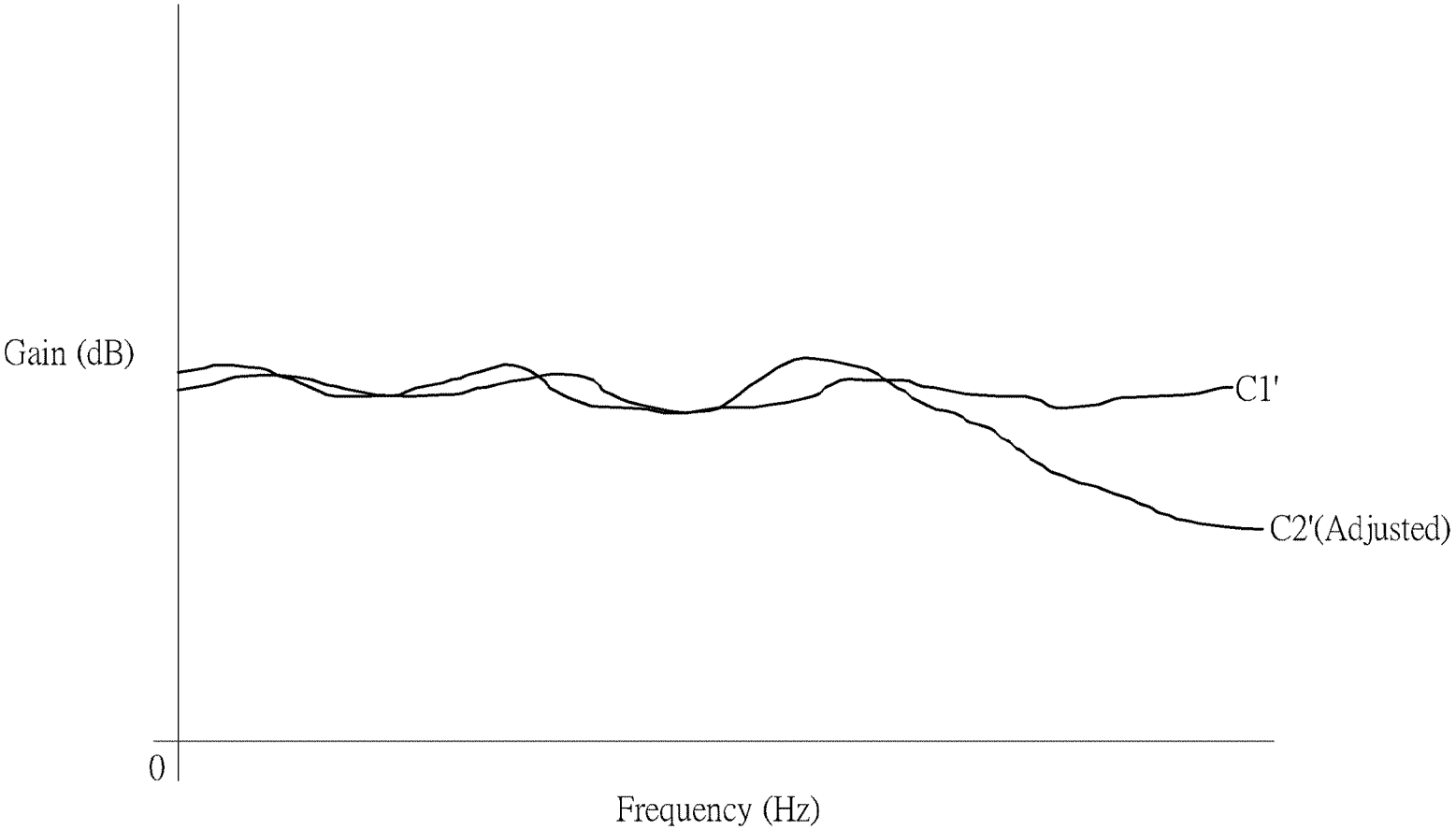
FIG. 8 is an illustration of equivalent equalizer gains heard by human ear and optimized by the headphone system in FIG. 1.

FIG. 8 is an illustration of equivalent equalizer gains heard by human ear and optimized by the headphone system 100. As previously mentioned, the headphone system 100 can optimize sound heard by human ear from the "initial" equalizer gain curve C1' to the equalizer gain curve C2' consistent with the standard equalizer gain curve according to the plurality of pressure values. Therefore, for any user, the headphone system 100 can generate audible sound with optimal frequency gains consistent with the (standard) equalizer gain curve C2'. In other words, the headphone system 100 can provide high tone quality for any user.

In the embodiments, the "standard equalizer gain curve" can be determined by system default parameters or user-defined parameters. For example, a user can customize several standard equalizer gain curves for different modes according to his/her own preferences. Further, the user can customize each frequency response on the standard equalizer gain curve. Therefore, when the headphone system 100 is used by another user, the user can re-define the standard equalizer gain curve for his/her specific preference. Thus, the headphone system 100 can provide high configuration flexibility for improving auditory experience. Further, in FIG. 6 to FIG. 8, equalizer gain curves C1, C1', C2, and C2' are introduced for presenting optimization of the sound heard by human ear. Particularly, the "human ear" can be defined as a right human ear. The sound can be generated by the first speaker 20*a*. Similarly, the second speaker 20*b* can also optimize the sound heard by a left human ear. Also, the sound heard by the left human ear can be consistent with the standard equalizer gain curve.

To sum up, the present invention discloses a headphone system. A headphone body of the headphone system can be a circumaural headphone body or a supra-aural headphone body. Since a closed space is generated between an earmuff module and a pinna, the closed space may be varied according to shape or size of a head or an ear. For compensating distorted frequency responses (or say, frequency gains) of sound heard by human ears, a plurality of pressure sensors are introduced for detecting pressures of positions around human ears. Then, a right speaker and a left speaker can be adjusted for outputting sound with optimal frequency gains according to the pressures of positions around human ears . By doing so, the sound heard by human ears can be consistent with a standard equalizer gain curve. Therefore, the headphone system can provide high tone quality and satisfactory auditory experience to any user.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A headphone system comprising:

a headphone body comprising:

a connection kit;

a first earmuff module connected to a first terminal of the connection kit, the first earmuff module comprising at least one first pressure sensor and a first speaker;

a second earmuff module connected to a second terminal of the connection kit, the second earmuff module comprising at least one second pressure sensor and a second speaker;

a connection port configured to receive an audio source signal; and a processor coupled to the at least one first pressure sensor, the at least one second pressure sensor, the first speaker, the second speaker, and the connection port, and configured to control the first speaker and the second speaker; and an audio source coupled to the connection port of the headphone body and configured to generate the audio source signal;

wherein when the first earmuff module and the second earmuff module are touched to ears, a plurality of contact pressures on different positions of the ears are generated, the plurality of contact pressures correspond to a plurality of pressure values, the processor receives the plurality of pressure values detected by the at least one first pressure sensor and the at least one second pressure sensor, and the processor sets a set of equalizer gains for controlling the first speaker and the second speaker according to the plurality of pressure values.

2. The system of claim 1, wherein the first earmuff module further comprises:

a first back cover support coupled to the connection kit; and a first earmuff device disposed on the first back cover support;

wherein the at least one first pressure sensor is disposed between the first back cover support and the first earmuff device, and the first earmuff device comprises a soft material.

3. The system of claim 2, wherein the first earmuff module is an airtight earmuff module, the first earmuff module further comprises a first partition disposed between the first back cover support and the first earmuff device, and the at least one first pressure sensor is disposed on the first partition.

4. The system of claim 2, wherein the connection kit comprises:

a first pivoted device disposed on the first terminal of the connection kit;

wherein the first back cover support rotates around the first pivoted device.

5. The system of claim 1, wherein the second earmuff module further comprises:

a second back cover support coupled to the connection kit; and a second earmuff device disposed on the second back cover support;

wherein the at least one second pressure sensor is disposed between the second back cover support and the second earmuff device, and the second earmuff device comprises a soft material.

6. The system of claim 5, wherein the second earmuff module is an airtight earmuff module, the second earmuff module further comprises a second partition disposed between the second back cover support and the second earmuff device, and the at least one second pressure sensor is disposed on the second partition.

7. The system of claim 5, wherein the connection kit comprises:

a second pivoted device disposed on the second terminal of the connection kit;

wherein the second back cover support rotates around the second pivoted device.

8. The system of claim 1, wherein the least one first pressure sensor is configured to detect at least one pressure value when the first earmuff module is tight behind a right ear, above the right ear, and/or under the right ear.

9. The system of claim 8, wherein the least one second pressure sensor is configured to detect at least one pressure value when the second earmuff module is tight behind a left ear, above the left ear, and/or under the left ear.

10. The system of claim 1, wherein the headphone body further comprises:

a memory coupled to the processor and configured to save the set of equalizer gains corresponding to the plurality of pressure values.

* * * * *